United States Patent [19]

Smith et al.

[11] 4,307,588

[45] Dec. 29, 1981

[54] AUTOMATIC CLOTHES WASHING MACHINES

[75] Inventors: Dennis E. Smith; Graeme D. Thomas; Keith D. Ferguson, all of Auckland, New Zealand

[73] Assignee: Fisher & Paykel Limited, Auckland, New Zealand

[21] Appl. No.: 122,834

[22] Filed: Feb. 20, 1980

[30] Foreign Application Priority Data

Feb. 20, 1979 [NZ] New Zealand ..... 189708

[51] Int. Cl.[3] ..... D06F 37/24; D06F 37/26

[52] U.S. Cl. ..... 68/23.7; 68/3 R; 312/253; 312/257 SM

[58] Field of Search ..... 68/3 R, 23 R, 23.3, 68/23.6, 23.7; 248/678; 312/253, 257 SM, 311; 134/200

[56] References Cited

U.S. PATENT DOCUMENTS

| | | | |
|---|---|---|---|
| 1,798,183 | 3/1931 | Voshardt | 134/200 X |
| 2,500,467 | 3/1950 | Pearce | 68/23 R X |
| 2,619,827 | 12/1952 | Castricone | 68/23.6 X |
| 2,633,726 | 4/1953 | Rand | 134/200 X |
| 3,391,469 | 7/1968 | Reeder | 68/23 R X |
| 4,007,612 | 2/1977 | Brimer | 68/23.3 X |

*Primary Examiner*—Philip R. Coe

*Attorney, Agent, or Firm*—Holman & Stern

[57] ABSTRACT

A clothes washing machine has a cabinet with either a back panel or front panel integral with two side panels and a removable front back panel. A platform integral with or mounted on stiffening members is fixed to the cabinet intermediate of the height thereof by shear resistant fastenings and a lightweight outer container containing an inner perforated frame is mounted on the platform. The washing and spinning mechanism is also supported by the platform.

5 Claims, 5 Drawing Figures

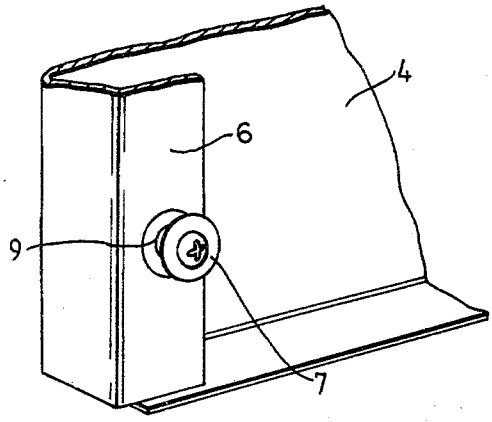
Fig. 2.
Fig. 4.
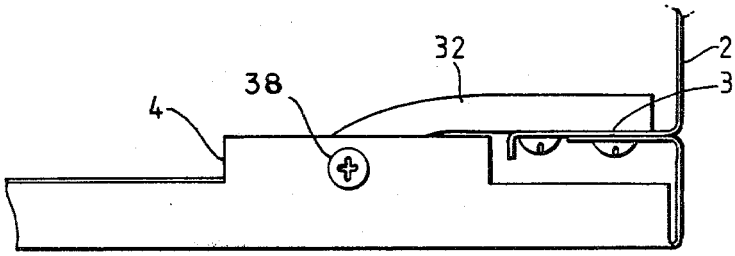
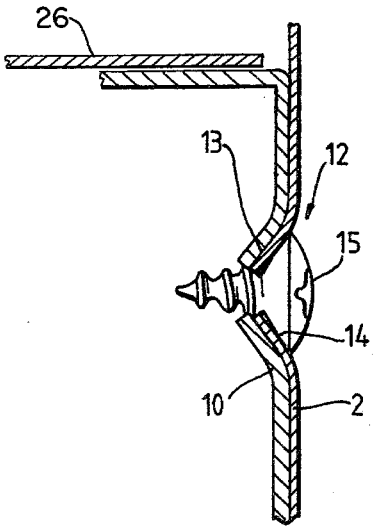
Fig. 3.
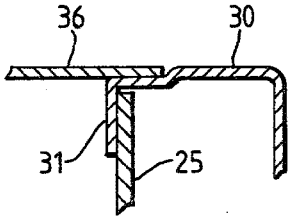
Fig. 5.

AUTOMATIC CLOTHES WASHING MACHINES

BRIEF SUMMARY OF THE INVENTION

Top opening clothes washing machines as at present constructed tend to be bulky and expensive because a frame separate from a cabinet thereof is usually provided to support the tub the washing and spinning mechanism.

Accordingly the invention consists in a clothes washing machine comprising a cabinet including two side panels a front panel and a back panel at least part of one of which is removable, the remaining parts of the cabinet being integral with each other, stiffening members arranged intermediate of the height of the fixed panels, said stiffening members supporting a clothes washing and spinning mechanism and a tub support platform intermediate of the height of the machine, the tub support platform in turn supporting a tub, an upper cover including a lid through which access to the tub is obtained, said tub comprising a leak proof outer container having walls the upper edge of which form a rim defining an opening thereto, a perforated rotatable bowl, also having walls the upper edge of which also define an opening forming a rim, part of said washing and spinning mechanism being within said bowl and part of said washing mechanism being mounted below said intermediate platform.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings in which:

BRIEF DESCRIPTION OF SEVERAL VIEWS OF THE DRAWINGS

FIG. 2 is an enlarged detail perspective view of a button used to connect the front panel to the side panels, FIG. 3 is an enlarged sectional detail view showing fixing means for stiffening members, FIG. 4 is an enlarged detail plan view showing the fixing of the cabinet front to other parts and, FIG. 5 is an enlarged cross sectional detail of an upper member of the machine.

DETAILED DESCRIPTION ACCORDING TO THE INVENTION

Figure 1:
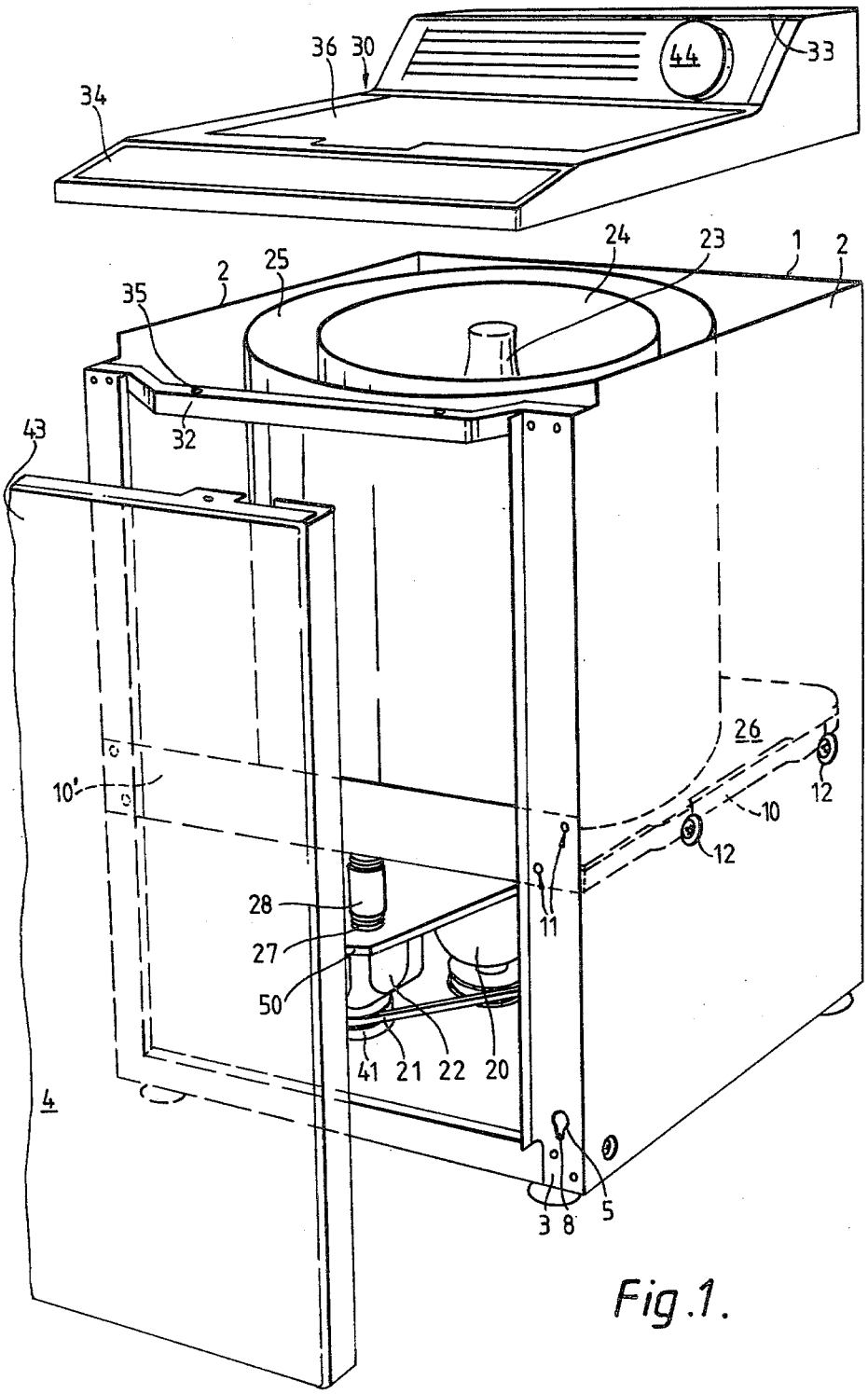
FIG. 1 is an exploded perspective view of a construction according to the invention, some of the parts being shown separately to show internal workings of the machine.

Referring to the drawings a clothes washing machine is constructed as follows.

The main part of a cabinet for a clothes washing machine comprises a sheet of prepainted sheet metal or sheet metal otherwise prefinished cut and folded to provide a back panel 1 (or if desired a front panel) and side panels 2, the side panels having inwardly folded flaps 3 (best shown in FIG. 4) whereby a removable front 4 (or if panel 1 is a front panel, then a back) is fixed to the side panels. The fixing of the front panel 4 (or back if appropriate) is effected at the lower end by a key hole slot 5 in each flap 3 the key hole engaging over a button 7 fixed to an inwardly turned flange 6 on the front panel 4 and the key hole 5 is placed over the button and to effect engagement the narrow portion 8 engaged over the narrow portion 9 of the button 7. If the removable panel is a back panel other fixings, e.g. self tapping screws may be used.

To support a clothes washing outer bowl 25 which forms part of a clothes washing tub, stiffening members 10 and 10' for example of folded sheet metal are folded to angle formation. Member 10' is fixed at 11 by screws for example to the side flaps 3 and member 10 is fixed by clear resilient fastenings e.g. by screw fixings 12 to the panels 2. The details of the screw fixing 12 is shown in FIG. 3 in which one of the angle members 10 is shown in section together with a part of a section of a side 2 and in both cases a depression 13 is made in the angle member 10 with a corresponding depression 14 in the side 2, a screw 15 passing through the base of the depressions, the screw being either a self tapping screw or a hash nut or similar fastening device. It will therefore be seen that a screw itself does not take the shear force between the member 10 and the side 2 but such shear force is taken by engagement of the walls of the depressions 13 and 14 one with the other. However alternatively or additionally other fixing means may be used including adhesives e.g. an epoxy adhesive or self piercing rivets. The use of adhesives assists in noise reduction.

The actual clothes washing and spinning mechanism comprises a motor 20 connected by a belt drive 21 to a gear box 22, the gear box 22 driving an agitator 23 within an inner bowl 24, the inner bowl 24 being perforated and fitting within the leak proof outer bowl 25. The washing mechanism spins the inner bowl 24 when appropriately actuated in the known way.

The gear box 22 and motor 20 are suspended from a platform 26 mounted on or integral with the stiffening members 10 and 10'. The members 10 are folded normally to the plane of platform 26. The suspension is effected by four springs 27, the springs being enclosed in damping tubes 28 of a resilient material such as rubber or a plasticised polyvinylchloride or some other energy absorbing material to give some damping to the suspension resulting from vibration, due, for example, to spin drying. The gear box 22, inner bowl 24 and agitator 23 are of substantially orthodox design, the inner bowl 24 being rotated at high speed for spin drying, and the agitator 23 being driven in a to and fro motion in the known way. The outer container 25 is supported on the flat platform 26 and consequently this bowl may be a relatively lightweight and easily manufactured bowl, for example, of a suitable plastics material having a cylindrical form with a disc or annular bottom and the open top end as a simple circular form either with or without a reinforcing rim. The outer drum 25 is mounted on the platform as stated in a leak proof manner.

The undersurface of the cabinet top 30 (FIG. 5) is provided with a downturned short cylindrical flange 31 which engages inside (as shown in FIG. 5) or outside the upper edge of the outer bowl 25 thus rigidifying not only the bowl 25 but also the whole cabinet.

The cabinet top or upper cover 30 is fixed to the cabinet members by screws through a front brace 32 and by screws concealed by a control panel cover 33 or if desired the cabinet top 30 may have a rear member (not shown) which is engaged through the back panel by screws. The front brace 32 also has screws 38 passing through holes 35 (FIG. 4) and these screws are concealed by a "snap in" insert 34 placed over the member 32. The upper member 30 is preferably made as a plastics moulding and includes an opening covered by a lid 36 through which access to the bowl 24 can be obtained.

The construction above described has a major advantage in that the height of the washing machine can be reduced considerably and, for example, for a 4 to 4½ kg load of clothes the height can be reduced to about 780 mm. Accordingly, steps are taken to reduce the height of the gear box mechanism 22 as much as possible and to this end it is preferable that a separate electric pump (not shown) is provided rather than a pump on an upper part of the motor 20. In addition the motor clutch mechanism 41 (which is at present used and is simply an overload or slipping clutch during certain cycles of the washing procedure) can be made smaller since with a separate electric pump the motor 20 can be stopped during pumping, unless of course spin drying is being carried out while the pump is running.

The construction at least in the preferred form has the advantages of being more compact and therefore economical both in material and in space, it utilises prepainted cabinet material, there are alternative positions 43 for a front control or 44 for rear mounted controls at the top. The rotating inner drum 24 may be provided with fluid filled balance rings, as described in U.S. Pat. No. 2,645,108.

Because of the intermediate platform 26 fixed to or integral with the stiffeners 10 and 10', the construction is very rigid for a relatively small amount of material. Also the supporting of the outer bowl 25 on the platform 26 enables that outer bowl to be of light construction e.g. a flexible material such as a plastics moulding, again reducing cost. The flange 31 on the undersurface of the cabinet top 30 engaging the outer bowl 25 also assists in providing rigidity while yet using a small amount of material.

Additionally the platform 26 provides a fire wall between the motor in particular below the platform and the combustible materials e.g. the plastics material of the outer container. Further fireproofing could be obtained by providing a floor (not shown) with appropriate ventilation to the lower compartment.

What is claimed is:

1. A clothes washing machine comprising a cabinet including a front panel and a back panel one of which is removable and two side panels, said panels, except the removable one, being integral with each other, stiffening members fixed to said integral panels in shear resistant manner intermediate of the height of the integral panels, a platform having a flat tub supporting surface supported on and in direct contact with said stiffening members, a moulded plastics cylindrical leak proof tub supported on and in direct contact with said tub supporting surface, said tub having an upper edge, a cabinet top engaged with said integral panels, a cylindrical flange depending from said top and engaging the upper edge of said tub to rigidify said tub and said cabinet, an opening in said top through which access to said tub is obtained, a lid for said opening, a perforated rotatable spinning bowl concentrically mounted within said tub, an agitator disposed within said bowl, a clothes washing and spinning mechanism supported from said platform and operatively connected to said bowl and agitator through said platform.

2. A clothes washing machine as claimed in claim 1 wherein said stiffening members and said platform are integral one with the other.

3. A clothes washing machine as claimed in claim 1 or 2 wherein said stiffening members are fixed to said integral panels by adhesive means.

4. A clothes washing machine as claimed in claim 1 wherein the integral panels of said cabinet are of prefinished sheet metal and said stiffening members are fixed thereto by shear resistant fastenings comprising mating depressions in said integral panels and said stiffening members, coaxial holes substantially centrally disposed in said depressions through said integral panels and said stiffening members, and self tapping screw fastenings extending through the holes in said integral panels and tightly engaging the holes in said stiffening members.

5. A clothes washing machine as claimed in claim 1 or 4 wherein said stiffening members comprise elongated sheet metal members folded into right angle cross-sectional shape, one leg of each member being fixed to a respective integral panel and the other leg of each member being fixed to said platform.

* * * * *